United States Patent [19]

Williams

[11] Patent Number: 4,458,848

[45] Date of Patent: Jul. 10, 1984

[54] REMOVABLE HEAD ROTARY TOOL FOR FOOD PROCESSORS

[75] Inventor: James E. Williams, Stamford, Conn.

[73] Assignee: Cuisinarts Research & Development, Inc., Greenwich, Conn.

[21] Appl. No.: 274,719

[22] Filed: Jun. 18, 1981

[51] Int. Cl.[3] ..... B02C 18/18

[52] U.S. Cl. ..... 241/92; 83/666; 241/278 R

[58] Field of Search ..... 241/92, 273.1, 273.2, 241/278 R, 282.1, 282.2, 199.12; 83/355, 356.3, 591, 666

[56] References Cited

U.S. PATENT DOCUMENTS

| | | | |
|---|---|---|---|
| 3,085,607 | 4/1963 | Schottle | 241/92 |
| 3,493,022 | 2/1970 | Mantelet | 241/199.12 |
| 3,892,365 | 7/1975 | Verdun | 241/282.1 X |
| 3,970,258 | 7/1976 | Mantelet | 241/282.1 |
| 4,190,208 | 2/1980 | Schaeffer et al. | 241/92 |
| 4,227,655 | 10/1980 | Williams | 241/92 |
| 4,277,995 | 7/1981 | Sontheimer | 241/92 X |

OTHER PUBLICATIONS

Copy of Prior Art Tool, 1/1980.

*Primary Examiner*—Mark Rosenbaum

*Attorney, Agent, or Firm*—Parmelee, Bollinger & Bollinger

[57] ABSTRACT

A horizontal disc-like tool head is detachably mounted on an upper coupling portion of an elongated hub, while a lower coupling portion of the hub is adapted to be coupled to and rotated by the tool drive shaft of a food processor. The tool head has a socket underneath it adapted to receive the upper coupling portion of the hub, which is inserted into this socket by motion in a horizontal, i.e. radial, direction parallel to the plane of the tool head, being held in the socket by a pair of detents. The elongated hollow hub includes a spring-loaded push rod or bolt lock in its bore which can be elevated into locking position between the detents and inserted into the socket to prevent the release of the socket from the hub during operation. This push rod includes a manual release button for withdrawing the push rod from the socket, thereby returning the detents to their original unlocked condition. By providing a variety of disc-like tool heads having different cutting structures for performing different food processing functions, a variety of operations may be performed conveniently by changing the tool heads, without requiring a separate hub for each rotary tool. Convenience is provided to the user, for the flat disc-like tool heads can be easily and compactly stored.

15 Claims, 5 Drawing Figures

Fig. 1.
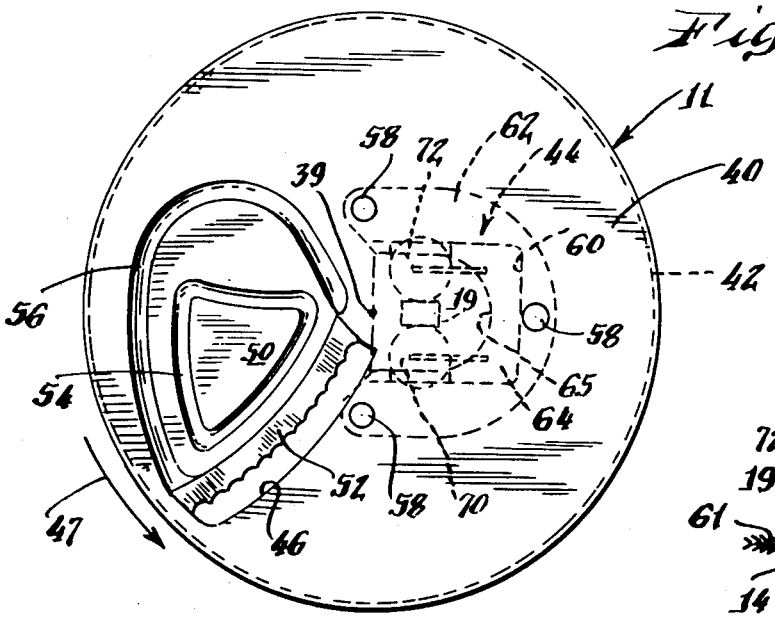
Fig. 3.
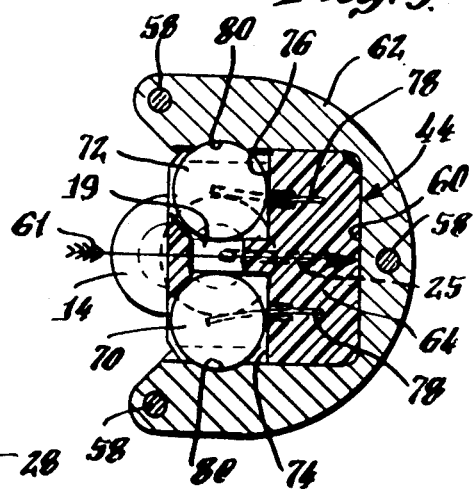
Fig. 2.
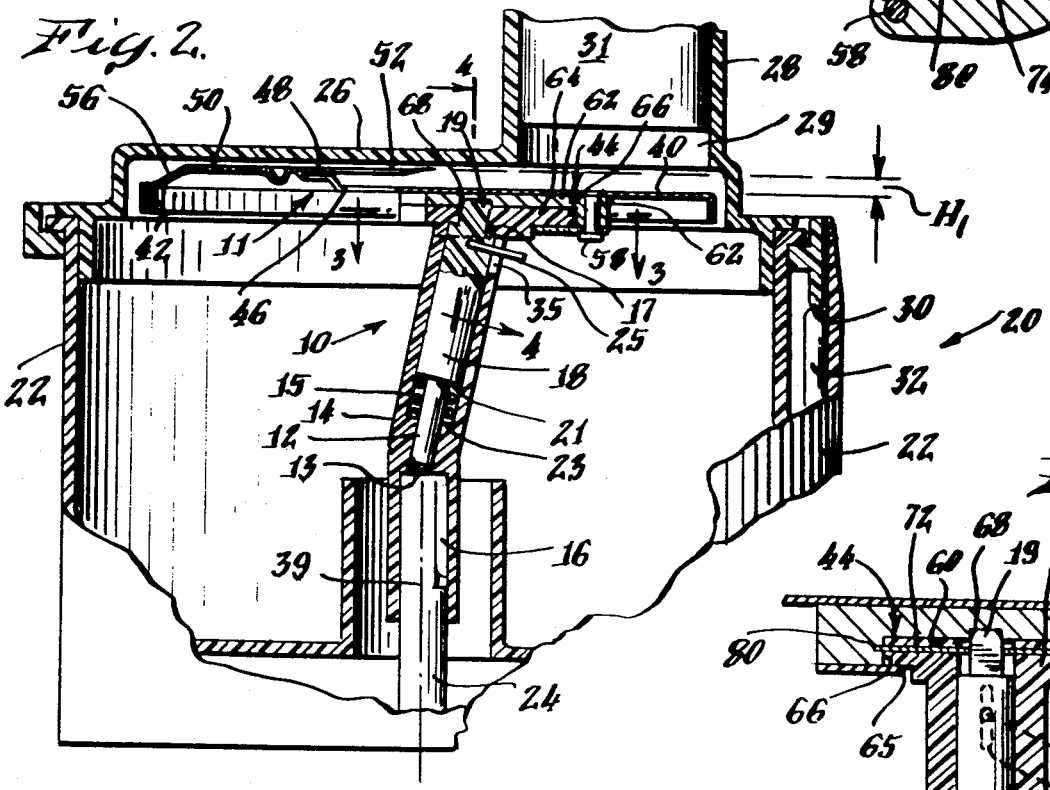
Fig. 4.
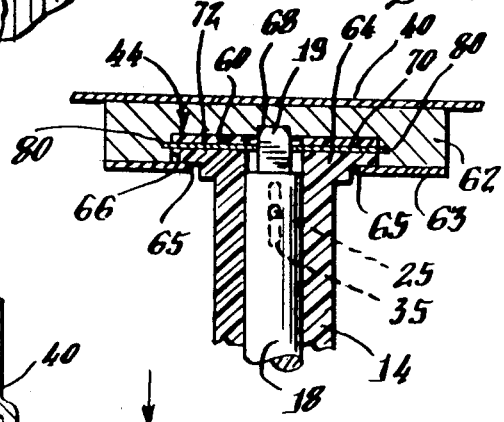
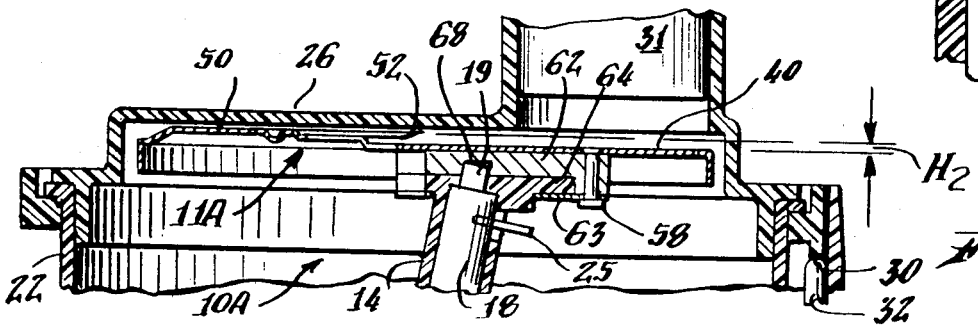
Fig. 5.

REMOVABLE HEAD ROTARY TOOL FOR FOOD PROCESSORS

FIELD OF THE INVENTION

This invention relates to rotary food processing tools for food processors, and more particularly to such rotary food processing tools which are provided with removable heads, whereby the parameters and functions of the tool may be varied as desired by the user by positioning removable and interchangeable heads on an elongated hub without requiring the elongated hub or tool shank for each tool head.

BACKGROUND OF THE INVENTION

The present invention is applicable to food processors of the type having a working bowl with a motor driven tool drive means projecting upward into the bowl with which various selected rotary food processing tools can be engaged to be driven for performing various food processing operations in accordance with the desires of the user. A removable cover is secured over the top of the bowl during use. The cover includes a feed tube having a feed passageway which opens downwardly through the cover into the top of the bowl, and food items to be processed are placed in the feed tube and then pushed down through the feed tube into the bowl by means of a removable food pusher which is adapted to slide down in the manner of a plunger through the feed tube. The food items are sliced or otherwise processed by the rotating food processing tool and the top of the bowl.

Additional information with respect to such food processors may be had by reference to U.S. Pat. Nos. 3,892,365-Verdun; 3,985,304-Sontheimer; 4,198,887-Williams; 4,200,244-Sontheimer; 4,216,917-Clare & Sontheimer; 4,213,570-Jones; 4,226,373-Williams; and 4,227,655-Williams.

Of particular interest to the present invention are rotary food processing tools which are used for slicing, dicing, cutting, rasping, grating, and for making French fry slices or julienne slices and the like from food items, such as potatoes, onions, carrots, cucumbers, celery, cabbage, squash, etc. Such rotary food processing tools have a horizontal disc-like member formed of sheet metal, preferably of stainless steel, which is mounted on an elongated hub extending down in the bowl of the food processor and which is coupled near its lower end to a motor-driven tool drive means. A horizontal cutting blade or other cutting or grating or rasping structure is associated with the horizontal disc-like member such that when items are cut they pass through one or more openings in the disc-like member into the bowl. The type of food processing which is performed by a rotary tool is determined by the type of cutting structure on the disc, the spacing and elevation of the cutting edges, the nature of the top surface of the disc, etc.

In the prior art, in order to change the parameters or the particular cutting function of a rotary food processing tool, the entire tool is removed from the bowl and replaced by another tool. Accordingly, a multiplicity of separate tools each having an elongated hub and a flat horizontal disc-like member are kept on hand for performing different types of food processing operations. The elongated hub or shank projecting from each disc-like member of the respective rotary tools may cause a storage problem in crowded kitchens with little storage space, when there is a need for having on hand a multiplicity of individual rotary tools of different types.

SUMMARY OF THE INVENTION

Accordingly, it is an object of this invention to provide a new and improved rotary food processing tool in which the parameters and functioning of such tools can be varied without replacing the entire tool.

A further object of this invention is to provide a new and improved rotary food processing tool which may provide a plurality of food processing functions by conveniently mounting a removable disc-like head on the elongated hub of the tool.

Among the advantages of the present invention are those resulting from the fact that this invention provides a new and improved rotary food processing tool in which a plurality of removable disc-like heads are easily mounted upon or removed from the shank or hub of the rotary tool, thereby varying the parameters and functioning of the rotary food processing tool without requiring an individual shank for each tool.

Still a further advantage of this invention is in the provision of a new and improved rotary food processing tool assembly for a food processor which enables the use of a single elongated hub or shank for different cutter heads, thereby providing a plurality of disc-like tool heads which may be stored relatively compactly.

In carrying out this invention in one illustrative embodiment thereof, a removable head rotary food processing tool is provided for use in a food processor of the type having an upright working bowl in which the rotary tool is mounted for rotation therein by a motor drive means. There is a removable cover secured to the bowl for covering the bowl and the rotary tool, and a feed tube for feeding food items to the rotary tool in the bowl. The removable tool head has an elongated hollow hub shank having an upper head coupling portion and a lower drive coupling portion adapted to be coupled to and rotated by the motor drive means. A horizontal disc-like tool head includes a disc-like member having a cutting structure thereon for processing food items applied thereto. The processed food items are directed through the cutting structure into the bowl. This disc-like tool head is removably mountable onto the upper coupling portion of said elongated hub, whereby other disc-like tool heads having different cutting structures for performing different food processing functions may be mounted on the same hub conveniently by changing heads without requiring a separate hub for each rotary tool. Manually releasable locking means are provided for preventing release of the tool head from the hub during operation.

Among the many advantages of the present invention are those resulting from the fact that a single elongated hollow hub or shank may be used for performing food processing operations simply by quickly and easily detachably mounting in locking engagement on the upper coupling portion of the hub various removable disc-like heads having different cutting structures. Since the horizontal disc-like tool heads, with the elongated hub detached, are relatively flat, they take up considerably less space, for example, when stored in a kitchen drawer, and are convenient to store in a stack one on top of another, rather than providing entire, separate rotary food processing tools for each operation to be performed at various times by the food processor.

The tool head includes a socket on its underside, and the upper coupling portion of the elongated hub advantageously is inserted into this socket by motion in a horizontal, i.e. radial, direction relative to the disc-like member of the tool head. Means are provided for holding the hub engaged in the socket and locking means prevent release of the holding means during operation of the tool in the food processor. By virtue of this horizontal socket engagement the tool head with the hub is securely and firmly attached to the hub for preventing displacement or misalignment of the tool head as a result of stresses imposed during the processing of various food items.

BRIEF DESCRIPTION OF THE DRAWINGS

The invention, together with further aspects, objects, features and advantages thereof, will be more clearly understood from a consideration of the following description taken in conjunction with the accompanying drawings, in which:

FIG. 1 is a top view of one type of rotary food processing tool embodying the present invention.

FIG. 2 is an elevational sectional view of the upper portion of the bowl and cover of a food processor containing the rotary food processing tool of FIG. 1.

FIG. 3 is a cross sectional view taken along line 3—3 of FIG. 2 and showing the socket of the tool head mounted and locked in place on the upper head coupling portion of the elongated hub, FIG. 4 is a cross sectional view taken along lines 4—4 of FIG. 2 showing the push rod or bolt lock in its extended position between the two detent members for locking the tool head in place, FIG. 5 is similar to the cross sectional view of FIG. 2 showing the use of a different removable tool head for producing a thinner slice than the type shown in FIG. 2.

DESCRIPTION OF THE PREFERRED EMBODIMENT

Referring now to FIGS. 1 and 2, a food processor, generally indicated by the reference number 20 includes an upright working bowl 22 with a motor-driven drive means 24 in the form of a shaft extending up into the bowl. A removable cover 26 having a feed tube 28 extending through the cover closes the bowl 22. At the same time, cam surface 30 on the cover 26 depresses an actuator rod 32 which closes a switch to enable operation of drive means (not shown) for driving the tool shaft 24. The feed tube 26 provides a feed passageway 29 for introducing food to be processed into the working bowl 22. A removable food pusher 31 and adapted to slide down into the feed tube 28 for pushing food items against the rotary food processing tool.

The rotary food processing tool, referred to generally with the reference number 10, includes a disc-like tool head 11 positioned near the cover 26 and has an elongated hollow hub 14 thereon with lower coupling means 16, for example such as a key or spline on the lower end of the elongated hub 14 which engages with the motor driven drive means 24 for rotating the tool 10.

The upper end of this elongated hollow hub 14 houses a spring-loaded push rod 18 serving as an extendable locking bolt and having an annular shoulder 17 and a locking projection 19 extending therefrom. The push rod 18 includes a lower annular shoulder 21 and a shaft 12 extending therefrom terminating in a rounded lower end 13 which is adapted to bear on the end of the tool shaft 24 when the tool 10 is mounted on the drive means 24. A spring 15 surrounds the shaft 12 and presses up on the shoulder 21 of the push rod 18. The lower end of this spring 15 seats down on an internal shoulder 23 within the bore of the elongated hub 14. The push rod 18 also has a manual release element 25 projecting outwardly thereform through a clearance slot 35 in the upper end of the hollow hub 10. The functioning of the push rod 18 and its release element 25 will be explained hereinafter.

As is illustrated in FIG. 2, the upper end of the elongated hub 14 on which the removable tool head 11 is detachably mounted is offset from the axis of rotation 39 of the tool 10, which is my preferred form of tool for the reasons described in U.S. Pat. No. 4,227,655 referred to above. The present invention, however, is not limited to such an offset hub arrangement but is also equally well applicable to rotary tools with a hub which is aligned along its entire length with the axis of rotation 39 of the tool.

The rotary food processing tool 10 illustrated is a rotary slicing implement. Its removable tool head 11, as seen in FIGS. 1 and 2, includes a disc-like member 40 of stainless steel having an opening 46. This opening 46 extends from a region near the axis of rotation 39 out toward the depending peripheral skirt 42 on the disc-like member 40. The tool 10 rotates in a counterclockwise direction as shown by the arrow 47. The region behind the opening 46 is pressed upwardly to form an elevated platform 50 having a front lip 48. This lip 48 carries an arcuate hardened steel slicing blade 52 which is fastened in place by spot welding. The slicing blade 52, which is illustrated as having a slightly scalloped or serrated cutting edge projects forwardly partially over and above the arcuate opening 46. The elevated platform 50 has downwardly embossed strengthening ribs 54 and a gradually downwardly sloping rear shoulder 56 extending around behind the elevated platform 50. The configuration of the platform 50 is to facilitate the slicing of food items being processed by the food processor 20. As the items are sliced they will pass through the slot 46 into the bowl 22 with as little interference as possible from the sloping shoulder 56 of the platform 50, as described and claimed in the Sontheimer U.S. Pat. No. 4,200,244.

In order to removably mount and lock the tool head 11 onto the upper end of the elongated hub 14, there are coupling means 44 permanently secured to the upper end of this hub 14. This coupling means 44 includes a horizontal ledge-like mounting flange 64 having a generally rectangular configuration as seen most clearly in top plan view in FIG. 3. This ledge-like flange 64 is attached to the hub 14 and can be engaged by relative horizontal sliding movement (as shown by the arrow 61 in FIG. 3) into a generally rectangular U-shaped socket 60 which has one of its four sides open for horizontally receiving this mounting flange 64. The rectangular U-socket 60 is provided underneath the disc-like member 40 of the removable tool head 11. The socket 60 is defined by a rounded U-shaped base 62 secured by rivets 58 to the disc-like member 40 of the tool head 11. In other words, the socket base 62 encircles three sides of the rectangular socket 60. Immediately below this socket base 62 is a metal plate 63, as shown most clearly in FIG. 4, which is secured to the bottom of the socket base 62 by the rivets 58. This plate 63 has inner edges 65 which extend inwardly approximately one-eighth of an inch beyond the periphery of the socket 60. Thus these inner edges 65 define a peripheral channel 66 which extends around three sides of the socket 60. The rectangular periphery of the ledge-like mounting flange 64 engages along its three edges into this channel 66 as seen in FIGS. 2 and 4.

In order to lock the mounting flange 64 into the channel 66, there are a pair of thin, circular detents 70 and 72 carried in narrow slots 74 and 76 in two opposite edge portions of the flange 64. These detents 70 and 72 are prevented from falling out of their slots 74 and 76 by a pair of retainer leaf springs 78. As shown in FIG. 3, one end of each retainer spring 78 is fastened to a respective detent and the other end is fastened to the flange 64. When the mounting flange 64 is fully inserted into the socket 60, the detents 70 and 72 are spread apart by the springs 78 to enter a pair of notches 80 in the channel 66, thereby firmly locking the mounting flange 64 into the socket 60.

It is the function of the projection 19 on the upper end of the push rod locking bolt 18 to hold the detents 70 and 72 spread apart to lock them into engagement in their respective notches 80. Thus, the mounting flanges 64 becomes captivated in the socket 60 for firmly and securely holding the tool head 11 onto the elongated hub 14. After the mounting flange 64 has been fully inserted into the socket 60, the spring 15 urges the push rod 18 upwardly for inserting the projection 19 between the detents.

When the hub 14 with its mounted tool head 11 is positioned down onto the drive means 24 (FIG. 2), the lower end 13 of the shaft 12 comes into contact with the upper end of the drive means 24, thereby causing the push rod 18 to remain elevated for wedging its projection 19 into position between the detents 71 and 72. As shown in FIG. 4, the uppr end of the projection 19 may be tapered for facilitating its wedging insertion between the inner edges of the detents 70 and 72 for locking them in their respective notches 80, thereby providing a first locking action which relies upon the push rod 18 and the detents 70, 72 and notches 80. There is a locking recess in the socket base 62 above the projection 19 as seen in FIGS. 2 and 4, and this projection 19 moves up between the detents 70 and 72 into the recess 68 for providing locking action so that the socket-defining base 62 cannot be removed from the upper end of the elongated hub 14, thereby providing a second locking action, which relies upon the push rod 18 and the locking recess 68.

In order to replace the tool head 11 with a different tool head 11A (FIG. 5), the elongated hub 14 is removed from the drive means 24. The user then presses down on the manual release element 25 against the force of the spring 15 for retracting the projection 19 from the locking recess 68. The projection 19 also becomes retracted from between the detents 70 and 72. Thus, these detents become free to move out of the respective notches 80 as the mounting flange 64 is removed from the socket 60, by moving it in the opposite direction from the arrow 61. The release element 25 is continuously pressed down during the removal of the tool head 11 and also during the positioning of the socket 60 of the next tool head 11A on the mounting flange 64. The shoulder 74 near the upper end of the push rod 18 acts as a stop for preventing the spring 15 from pushing this push rod out of the bore of the hub 14.

Accordingly, a pluraity of removably tool heads 11 and 11A each having a socket 60 thereon are provided, each of which has a different cutting structure or a cutting structure which performs a different function. In operation, it will best be seen in FIG. 4 that the mounting flange 64 on top of the elongated hollow hub 14 is slid as shown by arrow 61 (FIG. 3) into the socket 60 on the bottom of the horizontal disc-like member 40. The perimeter portions of the flange 64 are snuggly engaged above the inwardly projecting lips 65 of the metal plate 63 when the upper end of the hub is fully inserted into the socket, thereby firmly attaching the tool head to the hub. The flange 64 becomes locked into place in the socket 60 by the projection 19 of the push rod 18 located in the bore of the dog-leg hub shank 14. As will be seen in FIG. 2, the lower end 13 on the shaft 12 bears on the tool drive means 24 which holds the push rod 18 upward. Accordingly, the push rod is held elevated in locking position so long as the elongated hub is positioned on the tool drive means 24. This locking means prevents the separation of the tool head 11 or 11A from the elongated hub 14 during operation of the food processor, and the drive-engagement-responsive means 13, 18, 19 prevents release of the locking means whenever the lower end of the elongated hub is engaged in operating position on the drive means 24.

FIG. 5 illustrates the use of a tool head 11A similar to that illustrated in FIG. 2. However, the vertical separation of the blade 52 and the top of the horizontal disc member 40 represented by the distance $H_2$ in FIG. 5 is different from that shown in FIG. 2 by the distance $H_1$. In FIG. 5 the distance between the blade 52 and the top of the horizontal disc member 40 represented by $H_2$ is smaller than $H_1$ therefore cutting a thinner slice. In other words, removable heads 11 and 11A may be readily replaced on the elongated hub 14 for forming different tools 10, 10A, etc. to perform different cutting functions, for example, thinner slices, or thicker slices or completely different types of cutting heads may be installed, such as a rasping or grating head, a julienne strip cutter or a French fry cutter head may be installed on the elongated hub 14, at the desire of the user.

Among the advantages of this removable head tool is the convenience in storing the removable tool heads each of which has a generally flat disc-like overall configuration. The rather flat overall configuration of the removable heads permits the various removable heads to be stored compactly and requires only one elongated hub 14 for all of the tool heads.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A removable head rotary tool for use in food processors of the type having an upright working bowl in which said rotary tool is mounted for rotation within said bowl by motor drive means, a removable cover securable on said bowl for covering said bowl and said rotary tool during operation and a feed tube for feeding food items to said rotary tool in said bowl, said removable head rotary tool comprising:

an elongated hub having an upper coupling portion and a lower coupling portion, said lower coupling portion being adapted to be coupled to and rotated by said motor drive means, a horizontal disc-like tool head having cutting means thereon for processing food items applied to the tool head, mounting means for detachably mounting said horizontal disc-like tool head on said upper coupling portion of said hub for rotation therewith, locking means for locking said mounting means and the upper coupling portion of said hub firmly together for preventing their separation during operation, and said locking means including a releasable element manually movable relative to said mounting means, whereby other disc-like tool heads having different cutting structures for performing different food processing functions may be used on the same hub by changing tool heads without requiring a separate hub for each rotary tool.

2. A removable head rotary tool for use in food processors of the type having an upright working bowl in which said rotary tool is mounted for rotation within said bowl by motor drive means, a removable cover securable on said bowl for covering said bowl and said rotary tool during operation and a feedtube for feeding food items to said rotary tool in said bowl, said removable head rotary tool comprising:

an elongated hub having an upper coupling portion and a lower coupling portion, said lower coupling portion being adapted to be coupled to and rotated by said motor drive means, a horizontal disc-like tool head having cutting means thereon for processing food items applied to the tool head, mounting means for detachably mounting said horizontal disc-like tool head on said upper coupling portion of said hub for rotation therewith, said mounting means including a socket on the bottom of said disc-like tool head adapted to receive the upper coupling portion of said hub, locking means for locking said mounting means and the upper coupling portion of said hub firmly together for preventing their separation during operation, said locking means preventing said upper coupling portion of said hub from being withdrawn from said socket, and means in said elongated hub responsive to the engagement of said lower coupling portion with the drive means for preventing release of the locking means, whereby other disc-like tool heads having different cutting structures for performing different food processing functons may be used on the same hub by changing tool heads without requiring a separate hub for each rotary tool.

3. The removable head rotary tool set forth in claim 2, in which:

said locking release preventing means includes a push rod located in a bore within the elongated hub which bears against the drive means when the lower coupling portion of the hub is engaged in operating position with said drive means.

4. A removable head rotary tool for use in food processors of the type having an upright-working bowl in which said rotary tool is mounted for rotation within said bowl by motor drive means, a removable cover securable on said bowl for covering said bowl and said rotary tool during operation and a feedtube for feeding food items to said rotary tool in said bowl, said removable head rotary tool comprising:

an elongated hub having an upper coupling portion and a lower coupling portion, said lower coupling portion being adapted to be coupled to and rotated by said motor drive means, a horizontal disc-like tool head having cutting means thereon for processing food items applied to the tool head, mounting means for detachably mounting said horizontal disc-like tool head on said upper coupling portion of said hub for rotation therewith, said mounting means defining a socket on said tool head which opens horizontally, said upper coupling portion of the hub having a horizontally projecting flange which slides horizontally into said socket, and locking means for locking said mounting means and the upper coupling portion of said hub firmly together for preventing their separation during operation, said locking means including at least one detent extendable from said flange for engaging with said socket for preventing withdrawal of said flange from said socket, whereby other disc-like tool heads having different cutting structures for performing different food processing functions may be used on the same hub by changing tool heads without requiring a separate hub for each rotary tool.

5. The removable head rotary tool set forth in claim 4, in which:

a push rod is positioned for movement in a bore in said elongated hub, said push rod having an upper end which is engageable with said detent when said push rod is elevated relative to said hub for preventing release of the detent means from its locking position, and the lower end of said push rod being engageable by the drive means for elevating the push rod when the lower coupling portion of the hub is engaged with the drive means in operating position, thereby preventing release of the locking means whenever the tool is installed in operating position in the food processor.

6. A removable head rotary tool for use in food processors of the type having an upright working bowl in which said rotary tool is mounted for rotation within said bowl by motor drive means, a removable cover securable on said bowl for covering said bowl and said rotary tool during operation and a feed tube for feeding food items to said rotary tool in said bowl, said removable head rotary tool comprising:

an elongated hub having an upper coupling portion and a lower coupling portion, said lower coupling portion being adapted to be coupled to and rotated by said motor drive means, a tool head including a horizontal disc-like member having food processing means thereon, said tool head including a socket-defining means for defining a socket which opens horizontally below said disc-like member, said upper coupling means on said elongated hub including a flange projecting horizontally from said hub at right antles to the length of said hub for insertion into said horizontal opening in said socket, locking means for locking said upper coupling means in said socket, and said locking means including a releasable element manually movable relative to said socket.

7. A removable head rotary tool as set forth in claim 6, in which:

said socket-defining means includes a lip extending inwardly below said socket for defining a channel extending along the periphery of said socket, and said flange has an edge portion fitting snuggly into said channel when said flange is inserted into said socket.

8. A removable head rotary tool as set forth in claim 7, in which:

said locking means include holding means for holding said flange in said socket.

9. A removable head rotary tool for use in food processors of the type having an upright working bowl in which said rotary tool is mounted for rotation within said bowl by motor drive means, a removable cover securable on said bowl for covering said bowl and said rotary tool during operation and a feed tube for feeding food items to said rotary tool in said bowl, said removable head rotary tool comprising:

an elongated hub having an upper coupling portion and a lower coupling portion, said lower coupling portion being adapted to be coupled to and rotated by said motor drive means, a tool head including a horizontal disc-like member having food processing means thereon, said tool head including a socket-defining means for defining a socket which opens horizontally below said disc-like member, said socket-defining means includes a lip extending inwardly below said socket for defining a channel extending along the periphery of said socket, said upper coupling means on said elongated hub including a flange projecting horizontally from said hub at right angles to the length of said hub for insertion into said horizontal opening in said socket, the edge portion of said flange fitting snuggly into said channel when said flange is inserted into said socket, locking means for locking said upper coupling means in said socket, holding means are provided for holding said flange in said socket, and said locking means are provided actuatable into locking relationship with respect to said holding means for preventing release of said holding means during operation of the food processor.

10. A removable head rotary tool for use in food processors of the type having an upright working bowl in which said rotary tool is mounted for rotation within said bowl by motor drive means, a removable cover securable on said bowl for covering said bowl and said rotary tool during operation and a feedtube for feeding food items to said rotary tool in said bowl, said removable head rotary tool comprising:

an elongated hub having an upper coupling portion and a lower coupling portion, said lower coupling portion being adapted to be coupled to and rotated by said motor drive means, a tool head including a horizontal disc-like member having food processing means thereon, said tool head including a socket-defining means for defining a socket which opens horizontally below said disc-like member, and said socket-defining means including a lip extending inwardly below said socket for defining a channel extending along the periphery of said socket, said upper coupling means on said elongated hub including a flange projecting horizontally from said hub for insertion into said socket, said flange having an edge portion fitting snuggly into said channel when said flange is inserted into said socket, holding means for holding said flange in said socket, locking means actuatable into locking relationship with respect to said holding means for preventing release of said holding means during operation of the food processor, and said locking means being responsive to the engagement of the lower coupling portion of said elongated hub with said drive means for maintaining said locking means in locking relationship with respect to said holding means for preventing release of said holding means so long as said hub is engaged with said drive means.

11. In a rotary tool for use in a food processor, said rotary tool having an elongated hub whose lower end is adapted for engagement with tool drive means in the food processor and whose upper end carries a generally horizontal disc-like member having food processing means thereon, the improvement comprising:

a tool head including said disc-like member and means secured to said disc-like member defining a socket having an entrance below said disc-like member, said socket-defining means including at least one lip extending inwardly immediately below the level of said socket, said elongated hub being removably mountable to said tool head, the upper end of said hub including a horizontal ledge-like flange projecting out horizontally therefrom, said horizontal ledge-like flange being insertable into said socket with said flange snuggly engaging above said lip, when freely inserted into said socket, said horizontal ledge-like flange including at least one radially movable element projectable from said flange, said socket-defining means including a notch for receiving said radially movable element for securing said horizontal ledge-like flange in said socket for preventing removal during operation of the tool, and manually actuatable means for releasing said radially movable element from said notch for permitting removal of said elongated hub from said tool head.

12. In a rotary tool for use in a food processor, said rotary tool having an elongated hub whose lower end is adapted for engagement with tool drive means in the food processor and whose upper end carries a generally horizontal disc-like member having food processing means thereon, the improvement comprising:

a tool head including said disc-like member and means secured to said disc-like member defining a socket having an entrance below said disc-like member, said socket-defining means including at least one lip extending immediately below the level of said socket, said elongated hub being removably mountable to said tool head, the upper end of said hub including a horizontal ledge-like flange projecting out horizontally therefrom, said horizontal ledge-like flange being insertable into said socket with said flange snuggly engaging above said lip, when freely inserted into said socket, and manually releasable locking means are provided for locking said horizontal ledge-like flange into said socket for preventing removal during operation.

13. In a rotary tool for use in a food processor, said rotary tool having an elongated hub whose lower end is adapted for engagement with tool drive means in the food processor and whose upper end carries a generally horizontal disc-like member having food processing means thereon, the improvement comprising:

a tool head including said disc-like member and means secured to said disc-like member defining a socket having an entrance below said disc-like member, said socket-defining means including at least one lip extending inwardly immediately below the level of said socket, said elongated hub being removably mountable to said tool head, the upper end of said hub including a ledge-like flange projecting out horizontally therefrom, said upper end of said hub being insertable into said socket with said flange snuggly engaging above said lip, when freely inserted into said socket, manually releasable locking means for locking the upper end of said hub into said socket for preventing removal during operation, said manually releasable locking means being a longitudinally movable push rod located in a bore in said elongated hub, and spring means in said bore urging said push rod upwardly in said bore, the upper end of said push rod engaging said socket-defining means for locking said tool head onto said hub.

14. In a rotary tool for use in a food processor, the improvement as claimed in claim 13, in which:

the lower end of said push rod comes into contact with the tool drive means of the food processor when the lower end of said elongated hub is engaged with the tool drive means for holding the push rod elevated in its locking position for preventing release of the tool head from the hub during engagement of the hub with the tool drive means in the food processor.

15. In a rotary tool for use in a food processor, the improvement as claimed in claim 13, in which:

said socket-defining means includes a plurality of lips extending inwardly immediately below said socket, said lips being spaced about the periphery of said socket, and said flange includes a plurality of portion snuggly engaging above the respective lips when fully inserted into said socket.

* * * * *